US006668932B2

(12) United States Patent
Hess et al.

(10) Patent No.: US 6,668,932 B2
(45) Date of Patent: Dec. 30, 2003

(54) APPARATUS AND METHODS FOR ISOLATING A WELLBORE JUNCTION

(75) Inventors: Joseph E. Hess, Spring, TX (US); Benji Smith, Spring, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 70 days.

(21) Appl. No.: 10/115,783

(22) Filed: Apr. 4, 2002

(65) Prior Publication Data

US 2002/0108754 A1 Aug. 15, 2002

Related U.S. Application Data

(63) Continuation-in-part of application No. 09/637,494, filed on Aug. 11, 2000, now Pat. No. 6,439,312.

(51) Int. Cl.[7] ..... E21B 43/12

(52) U.S. Cl. ..... 166/313; 166/387; 166/50; 166/116; 166/191

(58) Field of Search ..... 166/244.1, 378, 166/380, 387, 313, 50, 116, 191

(56) References Cited

U.S. PATENT DOCUMENTS

| | | | |
|---|---|---|---|
| 2,728,395 A | | 12/1955 | Howard et al. |
| 2,894,588 A | | 7/1959 | Tausch et al. |
| 3,361,204 A | | 1/1968 | Howard et al. |
| 5,337,808 A | | 8/1994 | Graham |
| 5,526,880 A | * | 6/1996 | Jordan et al. |
| 5,623,993 A | * | 4/1997 | Van Buskirk et al. |
| 5,845,710 A | * | 12/1998 | Longbottom et al. |
| 5,941,307 A | | 8/1999 | Tubel |
| 5,971,073 A | | 10/1999 | Longbottom et al. |
| 6,062,306 A | | 5/2000 | Gano et al. |
| 6,065,543 A | | 5/2000 | Gano et al. |
| 6,092,602 A | | 7/2000 | Gano |

FOREIGN PATENT DOCUMENTS

| | | |
|---|---|---|
| EP | 0 701 045 A2 | 3/1996 |
| GB | 2333545 A | 7/1999 |
| GB | 23328919 A | 7/1999 |

OTHER PUBLICATIONS

European Search Report for Application No.: GB 0119587.4.

* cited by examiner

*Primary Examiner*—Roger Schoeppel
(74) *Attorney, Agent, or Firm*—J. Richard Konneker

(57) ABSTRACT

A wellbore junction isolation method and associated apparatus provide convenient isolation of a wellbore junction while permitting certain operations to be performed in a main or branch wellbore below the junction. In described embodiments, formations intersected by a main or branch wellbore below a wellbore junction may be stimulated by fracturing after installing an assembly at the wellbore junction, in a straddling and sealing relationship therewith, to isolate it from pressures applied during the fracturing operation. The illustrated isolation assembly may be installed in a single trip into the main wellbore.

26 Claims, 3 Drawing Sheets

APPARATUS AND METHODS FOR ISOLATING A WELLBORE JUNCTION

CROSS-REFERENCE TO RELATED APPLICATION

This application is a continuation-in-part of U.S. application Ser. No. 09/637,494 filed on Aug. 11, 2000, now U.S. Pat. No. 6,439,312 the disclosure of such application being hereby incorporated in its entirety herein by reference.

BACKGROUND

The present invention relates generally to operations performed in conjunction with a subterranean well and, in an embodiment described herein, more particularly provides a wellbore junction isolation method and associated apparatus.

Wellbore junctions are formed at intersections of wellbores in a well. For example, a main or parent wellbore may have a branch or lateral wellbore drilled extending outwardly from an intersection between the main and branch wellbores. Of course, the main wellbore may extend below the intersection with the branch wellbore, for example, to intersect a formation from which it is desired to produce hydrocarbons into the main wellbore.

Unfortunately, however, some wellbore junctions are not able to withstand substantial internal pressure applied thereto. For this reason, pressure within these wellbore junctions is limited to the fracture gradients of the respective formations in which the wellbore junctions are positioned. Thus, if stimulation operations, such as fracturing, must be performed for any formations below the wellbore junctions, expensive, time-consuming and/or complicated procedures must be used to prevent exceeding the fracture gradients of the formations at the wellbore junctions. Similar problems may also arise in other, non-stimulation types of well treatment such as, for example, circulation, washing and cleaning operations.

Therefore it would be quite desirable to provide a method of isolating a wellbore junction which is convenient and easily performed, and which isolates the wellbore junction from pressures applied through the junction.

SUMMARY

In carrying out the principles of the present invention, in accordance with an embodiment thereof, a method of isolating a wellbore junction is provided in which an isolating assembly is positioned at the wellbore junction and sealingly engaged with spaced apart wellbore portions. The assembly isolates at least one flow passage extending therethrough from the wellbore junction. Pressure may then be applied to the flow passage without that pressure being communicated to the wellbore junction.

The isolating assembly may be operatively positioned in different orientations to protectively isolate the junction from fluid pressure being exerted within either selected one of two intersecting wellbores such as a main wellbore and an intersecting branch wellbore.

In one aspect of the invention, the assembly includes two sealing devices which are sealingly engaged between the assembly and wellbore portions intersecting at the wellbore junction. The sealing devices are sealingly engaged straddling the wellbore junction. In this manner, an annulus formed between the assembly and the wellbore portions with which the sealing devices are sealingly engaged is divided into three portions, a middle one of which is in fluid communication with the wellbore junction.

In another aspect of the invention, the other two annulus portions are in fluid communication with each other via another flow passage formed through the assembly. Thus, a circulation flowpath is formed between the annulus portions above and below the wellbore junction extending through the assembly.

Preferably, the sealing structures are cup packers which permit the assembly to move longitudinally relative to the wellbore portions with which the assembly is sealingly engaged. This is particularly beneficial in subsea well applications in that the permitted assembly movement relative to the wellbore structure provides automatic compensation for rig heave. A variety of other types of sealing or slip joint structures which permit this compensation could alternatively be utilized if desired.

In yet another aspect of the invention, the assembly is conveniently installed in a single trip into the well and may be positioned entirely within a main wellbore portion or operatively extended from the main wellbore into an associated intersecting branch wellbore portion. A particular embodiment described herein includes inner and outer tubular structures, with the sealing devices on the outer structure, and the inner structure sealed to the outer structure above and below the sealing devices.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
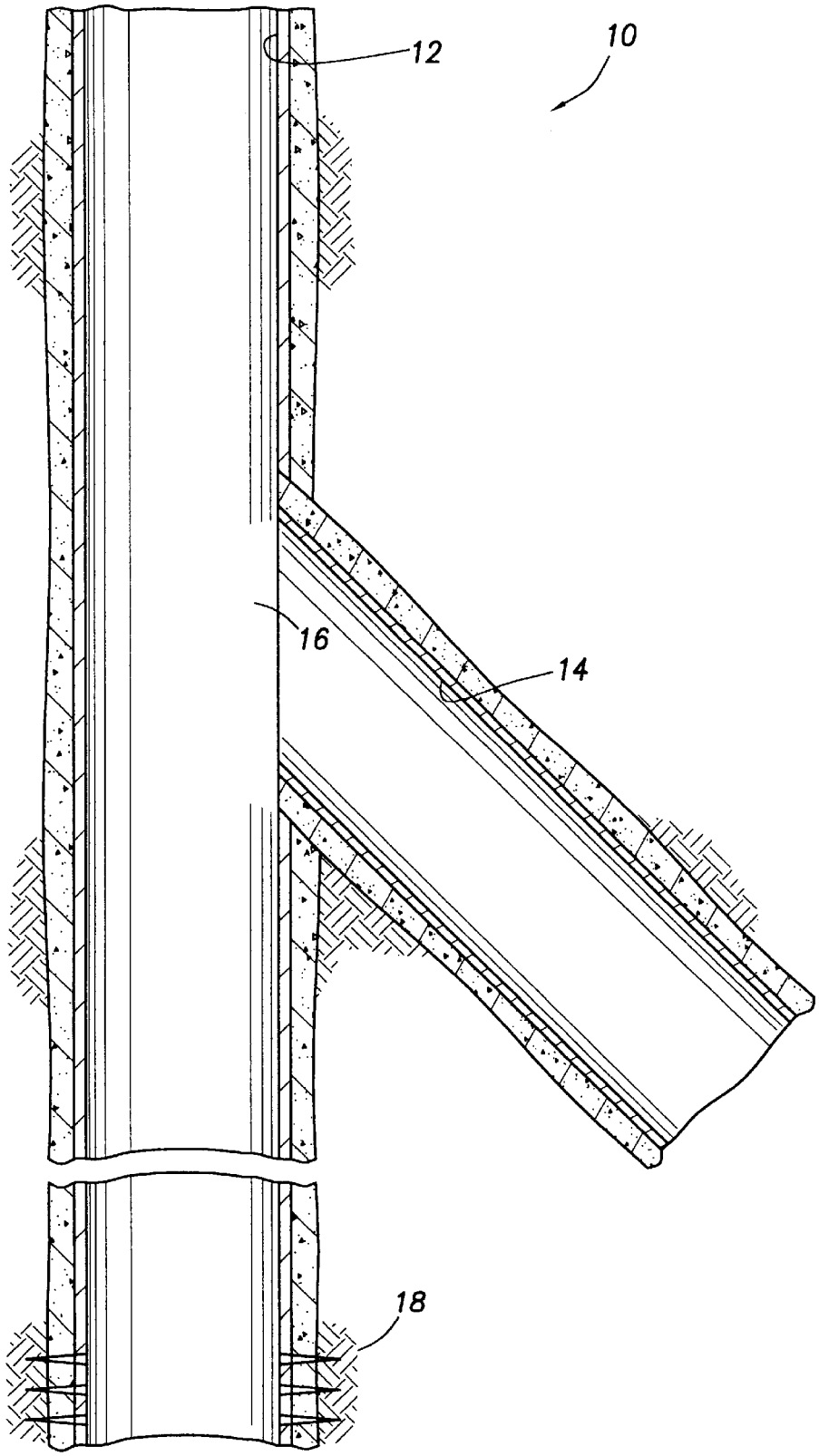
FIG. 1 is a schematic view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Specifically, the term "above" is used herein to designate a direction toward the earth's surface along a wellbore, and the term "below" is used herein to designate a direction away from the earth's surface along a wellbore, even though the wellbore may not be substantially vertical. Additionally, it is to be understood that the various embodiments of the present invention described herein may be utilized in various orientations, such as inclined, inverted, horizontal, vertical, etc., and in various configurations, without departing from the principles of the present invention.

Referring now to FIG. 1, the method 10 is described herein as being performed in a subterranean well, which may be a subsea well, at a wellbore junction 16 formed by an intersection between a main wellbore 12 and a branch wellbore 14. The wellbores 12, 14 are depicted in FIG. 1 as being cased or lined, but it is to be clearly understood that the principles of the invention may be incorporated into other methods performed in uncased or unlined wellbores. Furthermore, the principles of the invention are not limited to wellbore junctions formed between main and branch wellbores.

As illustrated in FIG. 1, the main wellbore 12 extends below the wellbore junction 16 to intersect a formation or zone 18. It is desired to perform a stimulation operation, such as fracturing, on the formation 18 to thereby increase production of hydrocarbons therefrom. However, it is also desired not to apply excessive internal pressure to the wellbore junction 16. Of course, the principles of the invention may be incorporated into other methods in which it is not desired to produce hydrocarbons from a formation, or in which it is not desired to perform stimulation operations.

Figure 2:
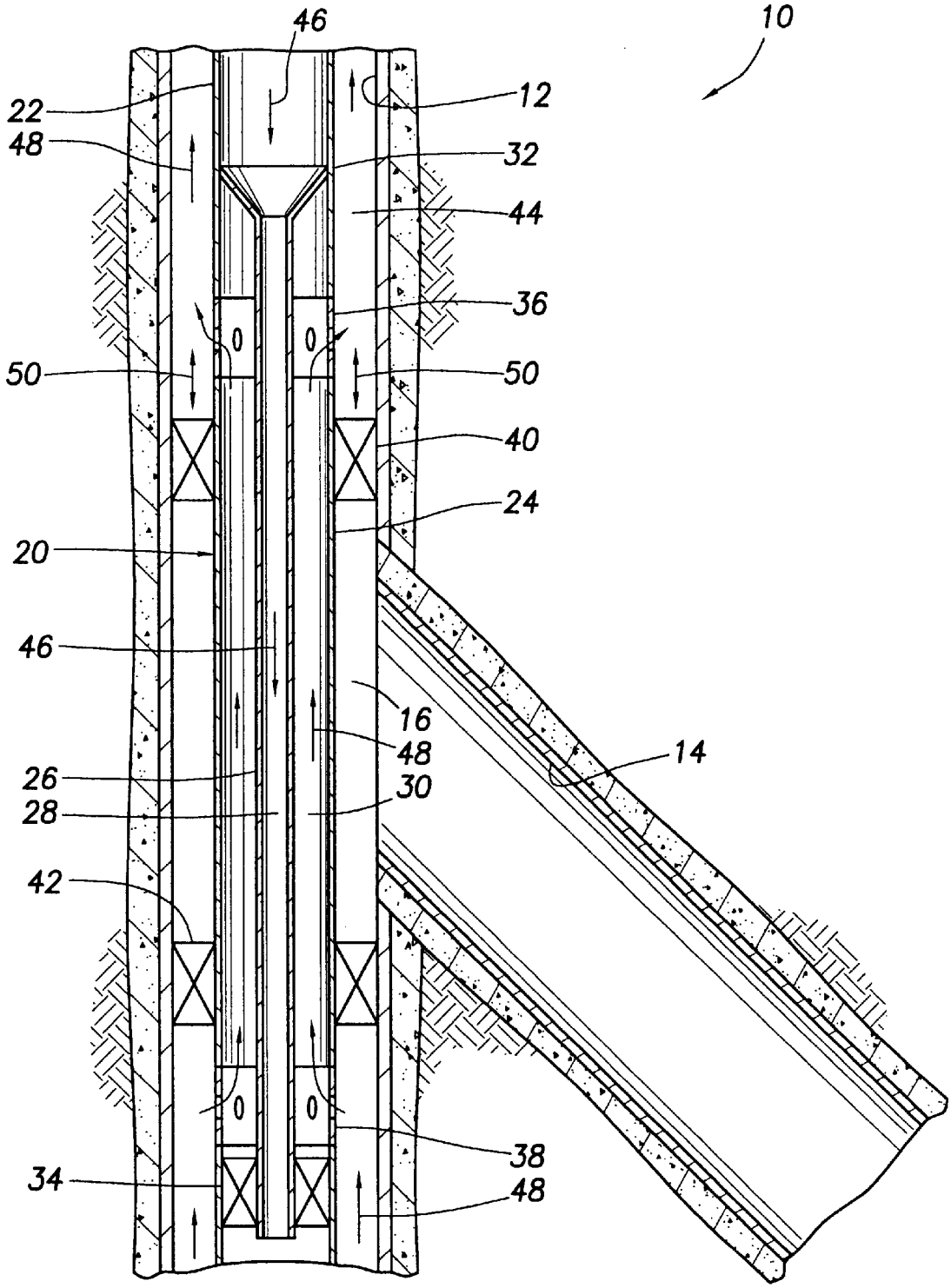
FIG. 2 is an enlarged scale schematic view of the method of FIG. 1, wherein an apparatus embodying principles of the present invention is being utilized in the method to isolate and protect a main/branch wellbore junction from fluid pressure being created within the main wellbore.

Referring additionally now to FIG. 2, a somewhat enlarged view of the wellbores 12, 14 and the junction 16 therebetween is representatively illustrated. Further steps of the method 10 have been performed in which a wellbore isolation assembly 20 is installed in the main wellbore 12 in a single trip. The assembly 20 is installed by conveying it into the wellbore 12 suspended from a work string 22.

The assembly 20 includes an outer tubular structure 24 and an inner tubular structure 26. For example, the outer structure 24 may include one or more lengths of liner and the inner structure 26 may include one or more lengths of tubing. A flow passage 28 is formed through the inner structure 26 and another flow passage 30 extends in the space between the inner and outer structures 24, 26.

The inner structure 26 is connected and sealed to the outer structure 24 at a three-way tubular connector 32. AS will be readily appreciated by those of skill in this particular art, a variety of other structures could alternatively be utilized to form this connection if desired. The connector 32 is also the point at which the work string 22 is attached to the assembly 20. The inner structure 26 is also sealed to the outer structure at a seal 34. Preferably, the seal 34 is an o-ring seal or packing received in a polished bore formed in the outer structure 24, but other types of seals may be used without departing from the principles of the invention.

The outer structure 24 further includes two ported subs 36,38 and two sealing devices 40,42. The upper ported sub 36 is positioned between the upper sealing device 40 and the connector 32. The lower ported sub 38 is positioned between the lower sealing device 42 and the seal 34. When the sealing devices 40, 42 are sealingly engaged in the main wellbore 12 as depicted in FIG. 2, the upper ported sub 36 provides fluid communication between the flow passage 30 and an annulus 44 formed between the assembly 20 and the wellbore 12 above the upper sealing device 40 via one or more ports in a sidewall of the upper ported sub, and the lower ported sub 38 provides fluid communication between the flow passage 30 and the annulus 44 below the lower sealing device 42 via one or more ports in a sidewall of the lower ported sub.

Preferably, the sealing devices 40, 42 are of the type well known to those skilled in the art as cup packers. However, other types of sealing devices may be utilized in keeping with the principles of the invention. In the method 10, the packers 40, 42 are positioned so that they straddle the wellbore junction 16 and thereby seal between the assembly 20 and the wellbore 12 above and below its intersection with the wellbore 14. In this manner, the annulus 44 is divided into three portions, a middle one of which is in fluid communication with the wellbore junction 16 external to the assembly 20. The upper and lower annulus 44 portions are in fluid communication with the flow passage 30 via the ported subs 36, 38.

To perform a fracturing operation, a slurry (indicated by arrows 46) including fluid and proppant is pumped down the work string 22, through the flow passage 28 and into the formation or zone 18. Return circulation of fluid (indicated by arrows 48) is directed from the annulus 44 below the lower packer 42 to the flow passage 30 through the lower ported sub 38, and then from the flow passage 30 to the annulus 44 above the upper packer 40 through the upper ported sub 36.

Note that the method 10 permits two flow passages 28, 30 to be positioned across the wellbore junction 16, the flow passages being isolated from each other and from the junction in the assembly 20, and permits the annulus 44 above and below the assembly to be isolated from the junction 16. This result is accomplished in only one trip into the well.

As previously mentioned, the sealing devices 40,42 shown in FIG. 2 are preferably cup packers. The use of the cup packers 42,42 permits the isolation assembly 20 to move longitudinally relative to the main wellbore 12 within which it is sealingly received, in both uphole and downhole directions, as indicated by the double-ended arrows 50 in FIG. 2. This feature of the illustrated isolation assembly 20 is particularly advantageous in subsea well applications in that it automatically compensates for rig heave. Other types of seal structures, or various types of slip joint structures such as a pressure balanced bumper sub and associated length of drill collars (not shown) above the assembly 20 could alternatively be utilized to provide this rig heave compensation if desired. Such alternate sealing or slip joint structures, as well as the illustrated cup packers 40,42, may be generally characterized as means associated with the assembly 20, for automatically compensating for rig heave without breaking he seals between the sealing devices 40,42 and their associated wellbore portions.

Figure 3:
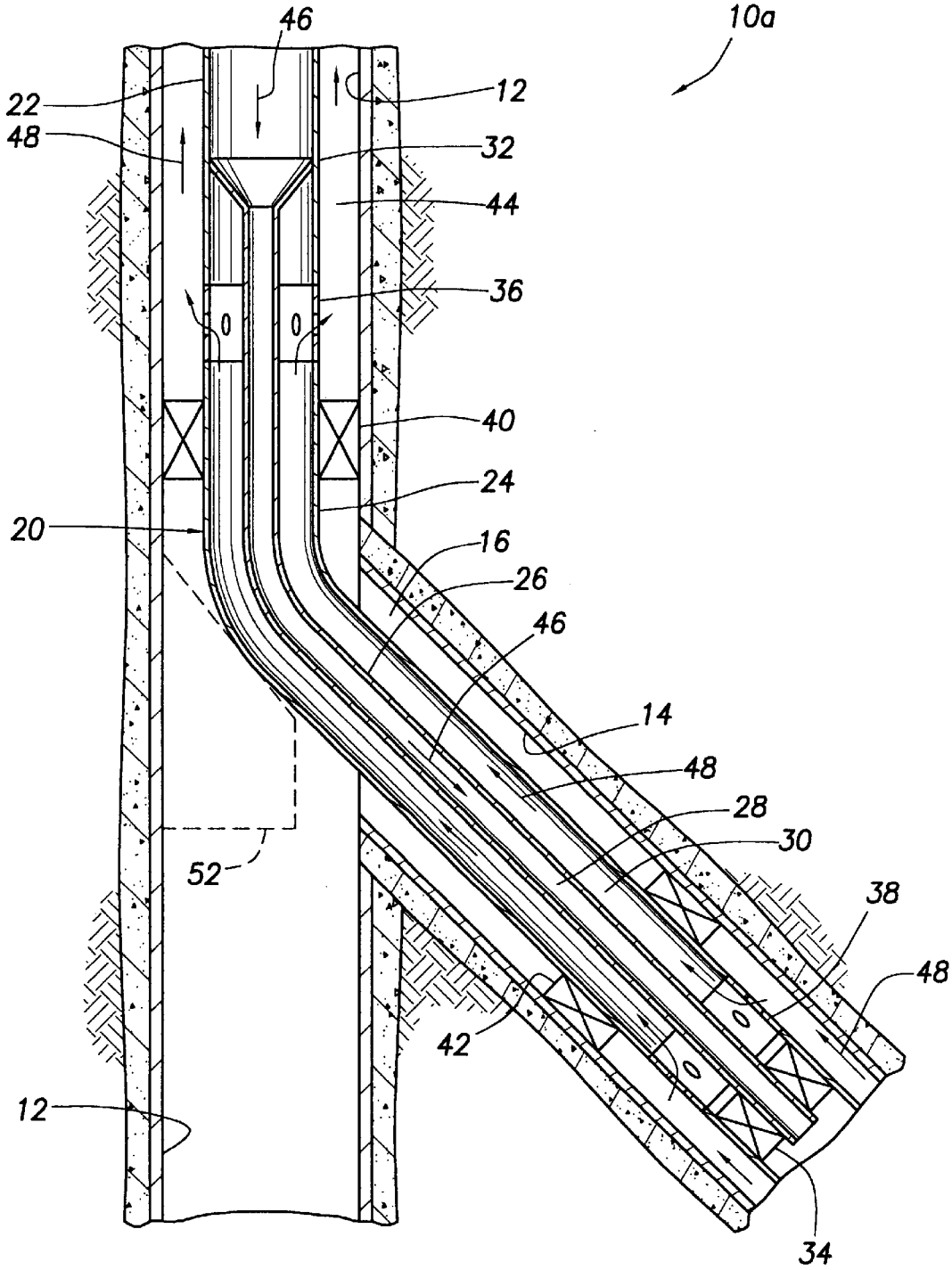
FIG. 3 is a schematic view similar to that in FIG. 2, but with the apparatus being used to isolate and protect the junction from fluid pressure being created within the branch wellbore.

Instead of being positioned entirely in the main wellbore 12 and protectively isolating the main/branch wellbore junction 16 from fluid pressure forces being exerted within the main wellbore 12 below the junction 16, the isolation assembly 20 may also be utilized, as schematically shown in FIG. 3, to isolate the junction 16 from fluid pressure being exerted in the branch wellbore 14 downhole from the junction 16. To effect this junction protection task a lower longitudinal portion of the assembly 20, when being moved downhole to operatively position it, is deflected into the branch wellbore 14 using a suitable conventional deflection device such as the schematically depicted whipstock structure 52 shown in phantom in FIG. 3.

With a lower longitudinal portion of the isolation assembly extended into and operatively installed within the branch wellbore 14 as schematically depicted in FIG. 3, the upper sealing structures 40 are sealingly engaged within the main wellbore 12 above the junction 16, and the lower sealing structures 42 are sealingly engaged within the branch wellbore 14 outwardly from the junction 16. The installed assembly 20 is operative to isolate the junction 16 from fluid pressure being exerted in the branch wellbore 14 downhole from the sealing devices 42—for example in conjunction with carrying out a fluid fracturing stimulation process (similar to that carried out in the main wellbore 12 as previously described herein with respect to FIG. 2) in a formation (not shown) penetrated by the branch wellbore 14.

Of course, a person skilled in the art would, upon a careful consideration of the above description of representative embodiments of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of isolating a junction between a first wellbore and a second wellbore extending outwardly from the first wellbore, the method comprising the steps of:

providing an elongated assembly including an outer generally tubular structure and an inner generally tubular structure, a first flow passage being formed through the inner structure and a second flow passage being formed between the inner and outer structures;

sealing a first longitudinal portion of the assembly within a first interior sealing area of the first wellbore uphole of the junction, and sealing a second longitudinal portion of the assembly within a second interior sealing area of a selected one of (1) a portion of the first wellbore downhole from the junction and (2) a portion of the second wellbore, in a manner such that the assembly sealingly straddles the junction with the first and second flow passages being isolated from the non-selected wellbore portion; and flowing fluid, via one of the first and second flow passages, through the assembly between the sealing areas while returning circulation of the fluid, via the other one of the first and second flow passages through the assembly between the sealing areas.

2. The method of claim 1 wherein the one of the first and second flow passages is the first flow passage.

3. The method of claim 1 wherein the selected wellbore portion is the portion of the first wellbore downhole from the junction.

4. The method of claim 1 wherein the selected wellbore portion is the portion of the second wellbore.

5. The method of claim 1 wherein the sealing steps are performed using packers providing sliding seals with the first and second interior sealing areas.

6. The method of claim 1 wherein the sealing steps isolate the junction from a first annulus portion formed between the assembly and the first wellbore above the junction, and wherein the flowing step further comprises flowing the fluid between the second flow passage and the first annulus portion.

7. The method of claim 6 wherein the sealing steps isolate the junction from a second annulus portion formed between the assembly and the selected wellbore portion below the junction, and wherein the flowing step further comprises flowing the fluid between the second flow passage and the second annulus portion.

8. The method of claim 1 wherein the inner structure is sealingly engaged with the outer structure at opposite ends of the inner structure.

9. The method of claim 1 wherein the assembly is positioned and operatively sealed within its associated wellbore portions in a single trip into the first wellbore.

10. For use in a subterranean well having a first wellbore extending downwardly from the surface, and a second wellbore extending outwardly from the first wellbore, a method of treating a formation intersected by one of the wellbores, the method comprising the steps of:

providing an elongated assembly including an outer generally tubular structure and an inner generally tubular structure, a first flow passage being formed through the inner structure and a second flow passage being formed between the inner and outer structures, the assembly further including first and second spaced apart external sealing devices;

lowering the assembly through the first wellbore in a manner such that the first sealing device is positioned in a portion of the first wellbore uphole of the junction, and the second sealing device is positioned within a selected one of (1) a portion of the first wellbore downhole from the junction, and (2) a portion of the second wellbore;

sealingly engaging the first and second sealing devices with their associated wellbore portions to thereby cause the assembly to sealingly straddle the junction; and flowing a well treatment fluid through one of the first and second passages into the selected wellbore portion.

11. The method of claim 10 wherein the flowing step is performed by flowing the well treatment through the first passage into the selected wellbore portion.

12. The method of claim 11 wherein in the flowing step the first flow passage is isolated from the non-selected wellbore portion.

13. The method of claim 10 wherein the first and second sealing devices are packers forming sliding seals with their associated wellbore portions.

14. The method of claim 10 wherein the selected wellbore portion is the portion of the first wellbore downhole from the junction.

15. The method of claim 10 wherein the selected wellbore portion is the portion of the second wellbore.

16. The method of claim 10 wherein in the sealingly engaging step, the first and second sealing devices divide an annulus formed between the assembly, a portion of the first wellbore above the junction, and the selected wellbore portion into first, second and third portions, the second portion being isolated from the non-selected wellbore portion.

17. For use in a subterranean well having a first wellbore extending downwardly from the surface and a second wellbore extending outwardly from the first wellbore at a junction therewith, a wellbore isolation system comprising:

an assembly including an elongated section having first and second sealing devices at opposite ends of the section, the first sealing device sealingly engaging a portion of the first wellbore uphole of the junction, and the second sealing device sealingly engaging a selected one of (1) a portion of the first wellbore downhole from the junction and (2) a portion of the second wellbore, the assembly thereby sealingly straddling the junction, the assembly further including an outer generally tubular structure and an inner generally tubular structure, a first flow passage being formed through the inner structure and a second flow passage being formed between the inner and outer structures; and fluid flowing through the section via the first flow passage, the first flow passage being isolated from the non-selected wellbore portion.

18. The wellbore isolation system of claim 17 wherein the second flow passage is isolated from the first flow passage and from the non-selected wellbore portion.

19. The wellbore isolation system of claim 18 wherein the second flow passage is in communication with the first wellbore above the section and with the selected wellbore portion below the section.

20. The wellbore isolation system of claim 17 wherein the second flow passage extends through a first port in the sidewall of the second structure above the first sealing device, and the second flow passage extends through a second port in the second structure sidewall below the second sealing device.

21. The wellbore isolation system of claim 17 wherein the assembly is operatively installed in a single trip into the first wellbore.

22. The wellbore isolation system of claim 17 wherein the first and second sealing devices slidingly and sealingly engage their associated wellbore portions.

23. The wellbore isolation system of claim 22 wherein the first and second sealing devices are cup packers.

24. The wellbore isolation system of claim 17 wherein the selected wellbore portion is the portion of the first wellbore downhole from the junction.

25. The wellbore isolation system of claim 17 wherein the selected wellbore portion is the portion of the second wellbore.

26. The wellbore isolation system of claim 17 wherein:

the well is a subsea well, and the wellbore isolation system further comprises means, associated with the assembly, for automatically compensating for rig heave without breaking the seals between the first and second sealing devices and their associated wellbore portions.

* * * * *